US007823881B2

(12) United States Patent
Böttger et al.

(10) Patent No.: US 7,823,881 B2
(45) Date of Patent: Nov. 2, 2010

(54) METHOD AND DELIVERY FOR A SHEET-PROCESSING MACHINE

(75) Inventors: Andreas Böttger, Heidelberg (DE); Andreas Detmers, Heddesheim (DE); Peter Förch, Neustadt (DE); Edmund Klein, Neckargemünd (DE); Oliver Lang, Sandhausen (DE); Sven Lippardt, Bensheim (DE); Markus Möhringer, Weinheim (DE); Patrick Roth, Kandel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 194 days.

(21) Appl. No.: 11/879,053

(22) Filed: Jul. 16, 2007

(65) Prior Publication Data

US 2008/0012217 A1 Jan. 17, 2008

(30) Foreign Application Priority Data

Jul. 14, 2006 (DE) ..... 10 2006 032 841

(51) Int. Cl.
*B65H 39/10* (2006.01)

(52) U.S. Cl. ..... 271/298; 271/183; 271/182

(58) Field of Classification Search ..... 271/182, 271/183, 298; 101/232, 240
See application file for complete search history.

(56) References Cited

U.S. PATENT DOCUMENTS

| | | | | |
|---|---|---|---|---|
| 2,093,228 | A * | 9/1937 | Barber | 271/182 |
| 4,210,078 | A * | 7/1980 | Greiner et al. | 101/136 |
| 5,377,587 | A | 1/1995 | Köbler | |
| 6,000,695 | A * | 12/1999 | Mack et al. | 271/303 |
| 6,659,453 | B2 * | 12/2003 | Kelm et al. | 271/183 |
| 2004/0113350 | A1 * | 6/2004 | Forch et al. | 271/69 |
| 2006/0042487 | A1 * | 3/2006 | Beitel et al. | 101/232 |
| 2006/0163800 | A1 * | 7/2006 | Forch et al. | 271/204 |

FOREIGN PATENT DOCUMENTS

| | | | |
|---|---|---|---|
| DE | 41 32 198 | A1 | 4/1993 |
| DE | 42 42 259 | A1 | 6/1994 |
| DE | 43 22 324 | A1 | 1/1995 |
| DE | 198 19 491 | C1 | 9/1999 |
| DE | 198 19 490 | C1 | 10/1999 |
| GB | 2 36 837 | A | 11/1999 |
| GB | 2 336 836 | A | 11/1999 |
| GB | 2336837 | A * | 11/1999 |

* cited by examiner

*Primary Examiner*—Patrick Mackey
*Assistant Examiner*—Ernesto Suarez
(74) *Attorney, Agent, or Firm*—Laurence A. Greenberg; Werner H. Stemer; Ralph E. Locher

(57) ABSTRACT

A method of depositing sheets coming out of a sheet-processing machine includes decelerating the sheets and depositing the sheets of a main pile. Certain sheets are decelerated and fed to a second sheet pile. The system includes a device for decelerating the sheets arriving from the sheet-processing machine and for depositing the sheets on a main pile. A chain gripper system is configured to hold and decelerate a trailing edge of the sheets. The chain gripper system includes an adjustable gripper opening cam.

7 Claims, 3 Drawing Sheets

METHOD AND DELIVERY FOR A SHEET-PROCESSING MACHINE

CROSS-REFERENCE TO RELATED APPLICATION

This application claims the priority, under 35 U.S.C. §119, of German application DE 10 2006 032 841.8, filed Jul. 14, 2006; the prior application is herewith incorporated by reference in its entirety.

BACKGROUND OF THE INVENTION

Field of the Invention

The invention relates to a method and a device for depositing selected sheets on an auxiliary pile upstream of a main pile.

German Patent DE 198 19 490 C1 and its British counterpart GB 2 336 836 A disclose a delivery with an auxiliary pile wherein sheets are fed to a waste sheet pile for poor quality prints at machine speed by way of a drum.

BRIEF SUMMARY OF THE INVENTION

It is an object of the invention to provide a delivery for a sheet-processing machine which is improved to overcome various disadvantages of the heretofore-known devices and methods of this general type and allows depositing sheets on an auxiliary or waste sheet pile in such a way that the pile is suitable for further processing.

With the foregoing and other objects in view there is provided, in accordance with the invention, a method of depositing sheets arriving from a sheet-processing machine. The method comprises:

decelerating the sheets and depositing the sheets on a main delivery pile; and selectively feeding selected, decelerated sheets to a second sheet pile.

In a preferred embodiment, the sheets are inspected and a determination is made as to which sheets are to be fed to the second sheet pile based on the inspection and a comparison between measured values and desired values.

With the above and other objects in view there is also provided, in accordance with the invention, a device for depositing sheets arriving from a sheet-processing machine, comprising:

a device for decelerating the sheets arriving from the sheet-processing machine and for depositing the sheets on a main pile;

a chain gripper system configured for holding and decelerating a trailing edge of a respective sheet, said chain gripper system including an adjustable gripper opening cam.

A particular advantage of the invention is that the sheets deposited on the auxiliary or waste sheet pile are deposited at a speed that is lower than the speed of the sheet-processing machine. As a result, a pile with straight edges can be formed, which is suitable for immediate further processing, for example in a die-cutting machine.

A particular advantage is the use of a trailing edge gripper for decelerating the sheets that are to be deposited on a main pile. After decelerating the sheets, the trailing edge gripper deposits the sheets that are to be deposited on the auxiliary or waste sheet pile on a conveying belt. The conveying direction to the waste sheet pile is against the conveying direction to the main pile.

In accordance with a further feature of the invention, the conveying belt may be a suction belt and may in addition be equipped with a deceleration drive.

To automate the sheet depositing sequence, a "vision control" inspection sensor is provided, which includes an ink density and register detection sensor and controls a gripper opening cam to operate the trailing-edge gripper on the basis of a comparison between measured values and desired values so that selected sheets are automatically deposited on the auxiliary or waste paper pile.

To protect the main pile, in particular the uppermost sheet, an air cushion is generated above the main pile on which the sheet to be deposited on the auxiliary or waste paper pile may float. Lateral blower nozzles are preferably provided to generate the air cushion.

To be able to process sheets of different sizes, the trailing-edge gripper bar is adjustable in and against the direction of sheet travel.

Other features which are considered as characteristic for the invention are set forth in the appended claims.

Although the invention is illustrated and described herein as embodied in delivery for a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
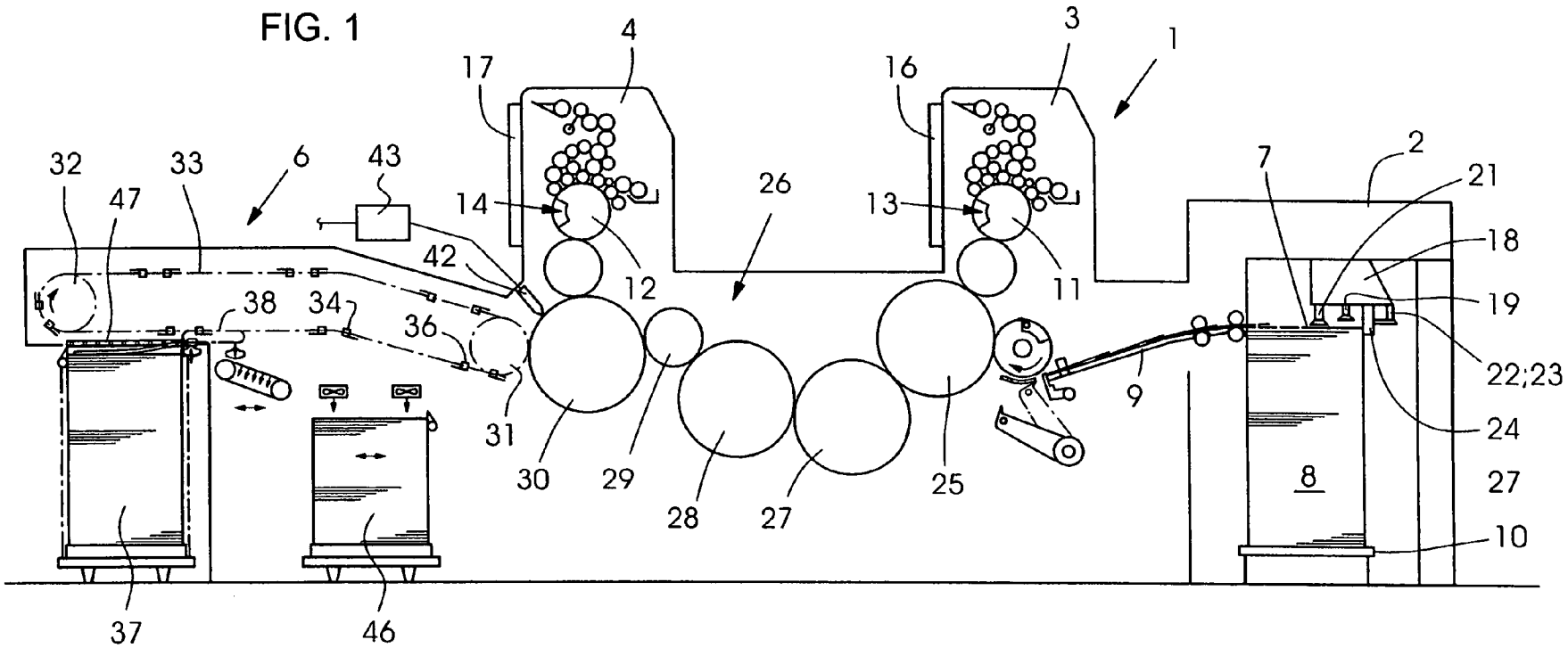
FIG. 1 is a diagrammatic sectional view of a sheet-fed rotary printing press.
Figure 2:
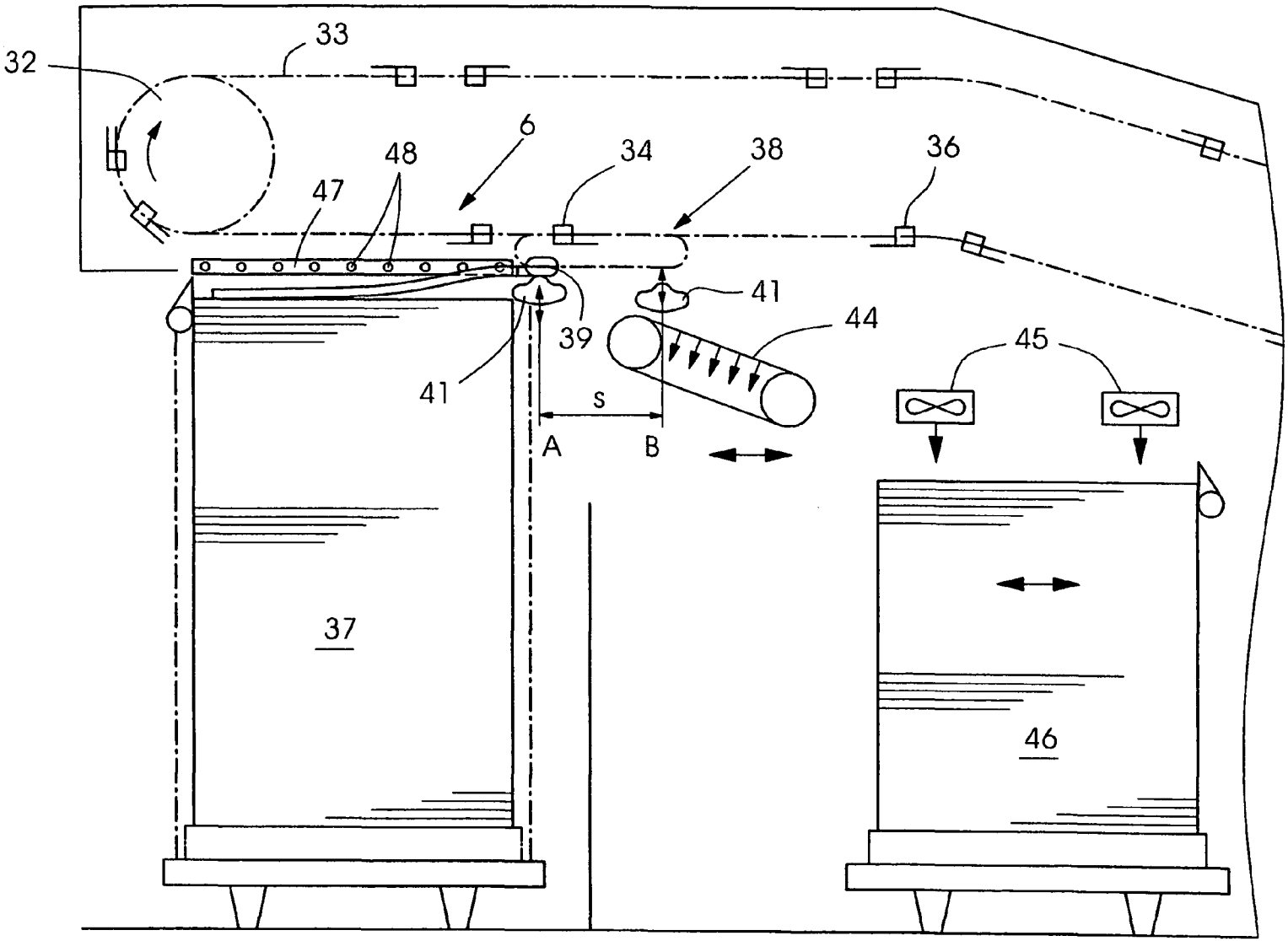
FIG. 2 is a diagrammatic side view of the delivery according to the invention.
Figure 3:
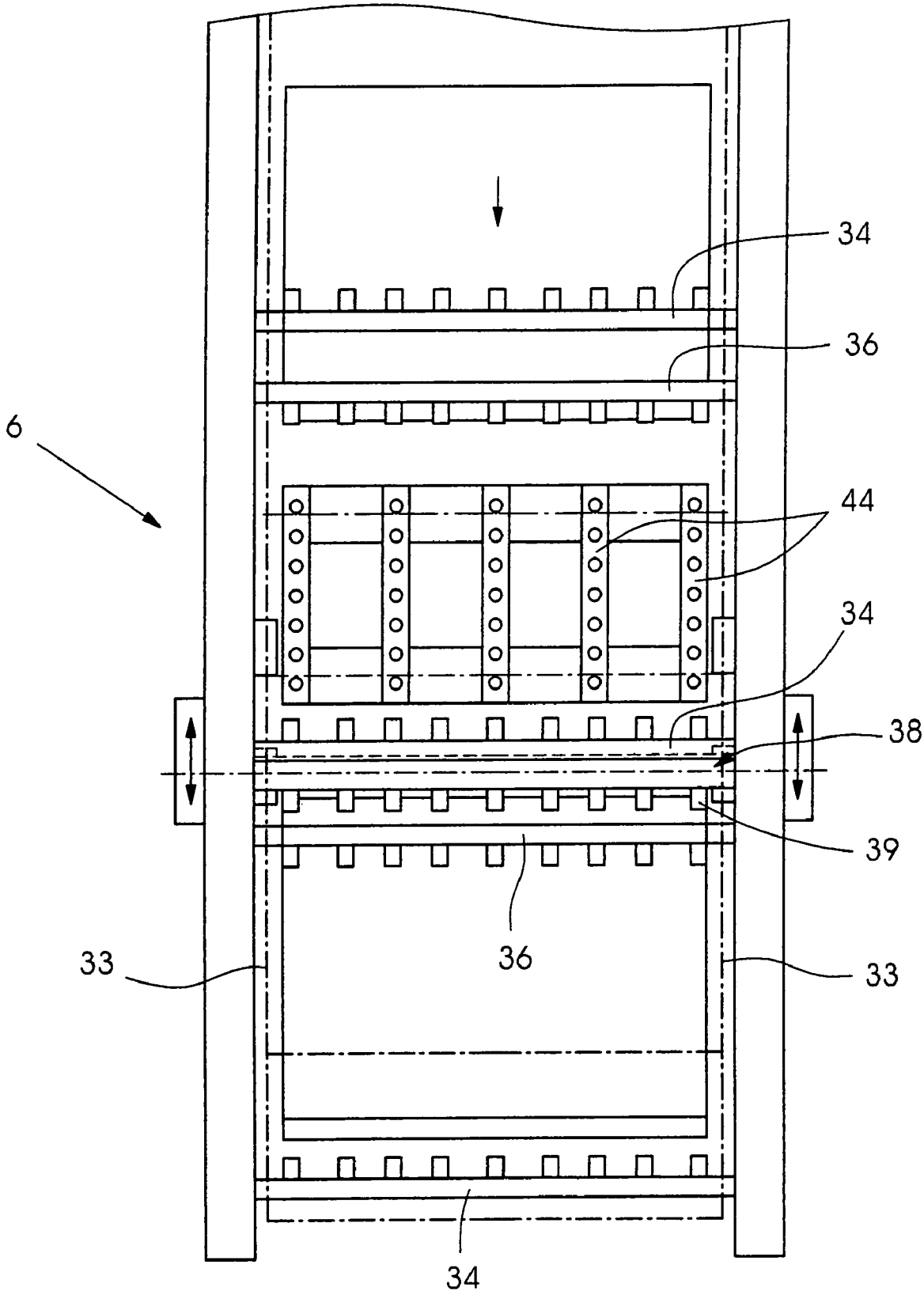
FIG. 3 is a diagrammatic plan view of the path of sheet travel in the delivery.

Referring now to the figures of the drawing in detail and first, particularly, to FIG. 1 thereof, the sheet-processing machine according to the invention may be, for example, a sheet-fed rotary printing press 1. The press 1 comprises a feeder 2 and at least one printing unit 3, 4. A delivery 6 follows the last printing unit. Sheets 7 are separated from a sheet pile 8, moved over a feed table 9, and fed to the printing units 3 and 4 either individually or in a shingled, imbricate stream. As it is known in the art, each of the printing units 3 and 4 includes a plate cylinder 11 and 12, respectively. Each of the plate cylinders 11 and 12 includes a device 13, 14 for locking flexible printing plates. In addition, a device 16, 17 for performing semi-automatic or automatic plate changes is associated with each of the plate cylinders 11, 12. A three-drum reversing device 27, 28, 29 is provided between the impression cylinders 25, 30 of the printing units 3, 4. The reversing device, which is of conventional construction, includes a transfer drum 27, a storage drum 28, and a reversing drum 29.

The sheet pile 8 rests on a pile plate 10, which can be lifted in a controlled manner. The sheets 7 are drawn from the upper side of the sheet pile 8 by means of a so-called suction head 18, which includes, among other features, a number of lifting and dragging suction cups 19, 21 for separating the sheets 7. In addition, the feeder comprises blower devices 22 for loosening the upper sheets and sensing devices 23 for causing the sheet pile 8 to be lifted. To align the sheet pile 8, in particular the upper sheets 7 in the pile 8, a number of lateral and rear stops 24 are provided.

The delivery 6 is designed as a chain delivery. Two parallel chains 33, which revolve endlessly about sprockets 31, 32, carry gripper bars 34 for holding the leading edges of the sheets and gripper bars 36 for holding the trailing edges of the sheets. A sheet braking or sheet deceleration system, for example in the form of another chain gripper system 38, is provided upstream of a sheet delivery pile. The chain gripper system 38 carries a gripper bar 39 for holding the trailing edge of the sheets. It is driven in accordance with the machine cycle of the sheet-processing machine and decelerates the sheet to be deposited from a print-run speed to a predetermined depositing speed. An adjustable gripper opening cam 41 opens the grippers of the gripper bar 39 to release the trailing edge of the sheets.

A "vision control" sheet inspection device 42 is preferably provided in the region of the last impression cylinder 30. The sheet inspection device 42 is equipped with an ink density and register detection sensor. It forwards measured values to a control computer 43. The control computer 43 carries out a comparison between measured values and desired values. If a deviation is detected, the gripper opening cam 41 is displaced. As a consequence, the sheet, which is held at the trailing edge by the gripper bar 39, is not released, but is dragged through a short distance s against the main depositing direction.

In a position B, which is spaced from a position A by the spacing distance s, the grippers of gripper bar 39 open and release the sheet. This causes the trailing edge of the sheet to be deposited on a conveying device 44. Conveying device 44 preferably consists of a suction belt that is driven in a pulsed manner and feeds the sheet to an auxiliary or waste sheet pile 46 at a depositing speed, which is lower than the print-run speed. Blower devices 45 are provided above the waste sheet pile 46 to assist the deposition of the sheets.

A blower bar 47 with a number of blower nozzles 48 is arranged above the main pile 37 to generate an air cushion above the main pile 37 by means of a stream of blast air directed parallel to the upper side of the main pile 37. This air cushion is activated whenever a sheet is to be deposited on the waste sheet pile 46 so that the sheet can be drawn off the main pile on the air cushion without contacting the main pile.

The invention claimed is:

1. A method of depositing sheets arriving from a sheet-processing machine, which comprises:

delivering the sheets from the sheet-processing machine while holding a leading edge and trailing edge of respective sheets;

decelerating the sheets while holding the sheets at the trailing edge and depositing the sheets on a main delivery pile;

maintaining a grip of the trailing edge of selected, decelerated sheets and feeding the selected sheets to a second sheet pile; and inspecting the sheets and determining which sheets are to be fed to the second sheet pile based on the inspection and a comparison between measured values and desired values.

2. A device for depositing sheets arriving from a sheet-processing machine, comprising:

a device for decelerating the sheets arriving from the sheet-processing machine in a sheet conveying direction towards a main pile and for depositing the sheets on the main pile or directing sheets to a waste sheet pile;

a sheet inspection system disposed to inspect and measure the sheets in-line;

said device for decelerating the sheets including a chain gripper system having a trailing edge gripper bar configured for gripping a trailing edge of a respective sheet, said chain gripper system including an adjustable gripper opening cam for directing the sheets to a correct one of said piles in accordance with said sheet inspection system;

a conveying belt disposed between the main pile and the waste sheet pile, said conveying belt being configured for transporting the sheets in a direction opposite said sheet conveying direction and depositing the sheets in the waste sheet pile, in accordance with said sheet inspection system.

3. The device according to claim 2, which comprises a blower bar disposed above the main pile.

4. The device according to claim 3, comprising blast-air nozzles disposed at said blower bar and oriented to blow air in a horizontal direction.

5. The device according to claim 2, wherein said sheet inspection system acquires and transmits measured values to a control computer, and said control computer is configured to control said adjustable gripper opening cam in dependence on a comparison between measured values acquired by said sheet inspection system and desired values.

6. The device according to claim 2, wherein said conveying belt is a suction belt.

7. A sheet-fed printing press comprising the device according to claim 2 disposed in a delivery of the sheet-fed printing press.

* * * * *